United States Patent [19]

Salomon

[11] 4,218,071

[45] Aug. 19, 1980

[54] SKI SAFETY BINDING WITH AUTOMATIC COMPENSATING MECHANISM

[75] Inventor: Georges P. J. Salomon, Annecy, France

[73] Assignee: Etablissements Francois Salomon et Fils, Annecy, France

[21] Appl. No.: 889,084

[22] Filed: Mar. 22, 1978

[30] Foreign Application Priority Data

Mar. 29, 1977 [FR] France ..... 77 09363

[51] Int. Cl.[2] ..... A63C 9/08

[52] U.S. Cl. ..... 280/630

[58] Field of Search ..... 280/625, 626, 628, 630

[56] References Cited

U.S. PATENT DOCUMENTS

| | | | |
|---|---|---|---|
| 3,632,123 | 1/1972 | Salomon | 280/628 |
| 3,909,030 | 9/1975 | Beyl | 280/630 |
| 4,095,821 | 6/1978 | Salomon | 280/630 |

*Primary Examiner*—Robert R. Song

*Attorney, Agent, or Firm*—Pollock, Vande Sande & Priddy

[57] ABSTRACT

A ski safety binding is provided with a mechanism for compensating for undesired variations in vertical retention stress, e.g., friction between the sole of the ski boot and the boot retaining jaw of the binding. The mechanism comprises two members movable relative to one another, the first being a spring-loaded piston, and the second a rocking member mounted in a seat of the piston or on an axle integral with it, for rocking movement about an axis transverse to the direction of sliding movement of the piston. The rocking member acts against the action of both the spring biasing the piston, and the boot retaining jaw.

14 Claims, 11 Drawing Figures

10
9"
9
11
12
5
6
III
III
2
8
7
1

6
4
1
2
5
9"
13
X
X'
10
3
11

6
10
6'
9'

10
4
21
9''
C
20
11
8
9'
18
5'
5
6
15
e
Y
Y'
16
I
2
13
7
19
7'
17
14

21
14
15
13
$R_0$
$R_1$
18
17
$R_2$
4

$R_4$
14
$R_0'$
21
20
19
$R_3$

4
G
11
8
N
6
7
17
14

SKI SAFETY BINDING WITH AUTOMATIC COMPENSATING MECHANISM

BACKGROUND OF THE INVENTION

The present invention relates to a ski safety binding which is releasable laterally, and possibly vertically with respect to the ski, against the action of a resilient locking arrangement. This type of binding is intended to assure the safety of the skier in response to torsional stresses on the leg bone (lateral release), and comprises:

(1) a vertical pivot integral with a base attached to the ski;

(2) a binding member swingably mounted on the pivot and carrying means for holding the boot;

(3) a locking arrangement comprising holding means mounted in the binding member and assuring the retention of the boot in a predetermined position on the ski, the arrangement comprising at least one resilient element and opposing a vertical and a lateral retention force, respectively to vertical elevation and to lateral displacement of the boot, said resilient element being preset to permit release of the boot when it is placed under a predetermined constraint in the plane of the ski; and (4) a compensating mechanism acting upon the locking arrangement to produce variations in the lateral retention stress on the boot inverse to the variation in the vertical retention stress, said compensation mechanism comprising two members movable relative to one another, the mechanism compensating for the increase in the boot retaining force during constraint on the binding member in a vertical plane, e.g., in the event that snow is present between the sole of the boot and ski, producing friction between the retaining means and the sole of the boot.

SUMMARY OF THE INVENTION

Such compensation effect is described in detail in French Pat. No. 75.19439. The present invention relates to several embodiments of a similar type of safety binding, but having a structure different from that disclosed in the aforementioned patent. In particular, the compensating mechanism according to the present invention comprises:

(1) a first member mounted for slidable translation movement in a recess of the binding member and biased in the direction of a reaction member fixed on the ski by a resilient element of the locking arrangement; and (2) a second member movably mounted on the first member, in a manner allowing it to rock about an axis extending transversely to the direction of sliding movement of the first member and parallel to the plane of the ski, said second, rocking member being subjected to opposing action both of the resilient element and of the boot retaining means.

Preferably, the direction of sliding movement of the first member is substantially parallel to the plane of the ski, and the fixed reaction member is solid with the fixed vertical pivot about which the binding member swings, the reaction member preferably comprising a vertical flat part formed on the fixed pivot. It will be understood that the reaction member may have different shapes, e.g., a profile cut in relief or hollow, without departing from the scope of the invention.

Various embodiments of the compensating arrangement may be devised. Thus, according to a first embodiment, the first member comprises a sliding piston on which the resilient element abuts, the second or rocking member being mounted in articulated manner on an axle integral with the piston, such that the rocking member is interposed between the piston and the fixed reaction member. In this embodiment, the rocking member cooperates with the reaction member by a ramp system making it possible to vary the point of contact of the rocking member and the fixed reaction member as a function of the rocking amplitude in response to displacement of the boot retaining means.

Acccording to a second embodiment, the first, sliding member also comprises a piston and the second member a rocking member mounted in a seat in the piston for pivoting movement, the piston being interposed between the rocking member and the fixed reaction member, and the thrust of the resilient element being exerted directly on the rocking member.

BRIEF INTRODUCTION TO THE DRAWINGS

Other characteristics and advantages of the present invention will appear from the following description which follows by way of example, and which is illustrated by the accompanying drawings wherein.

DESCRIPTION OF PREFERRED EMBODIMENT

Figure 1:
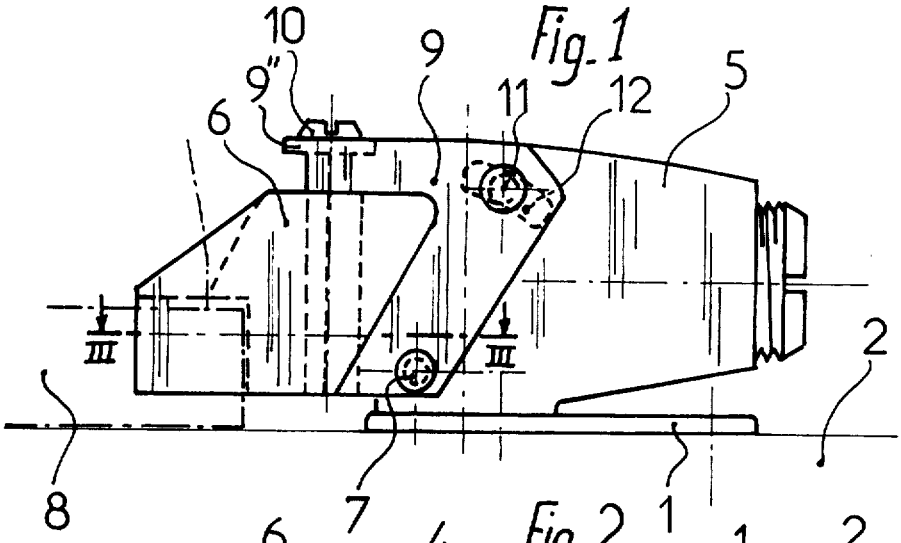
FIG. 1 is a side elevation of a binding according to the invention.
Figure 2:
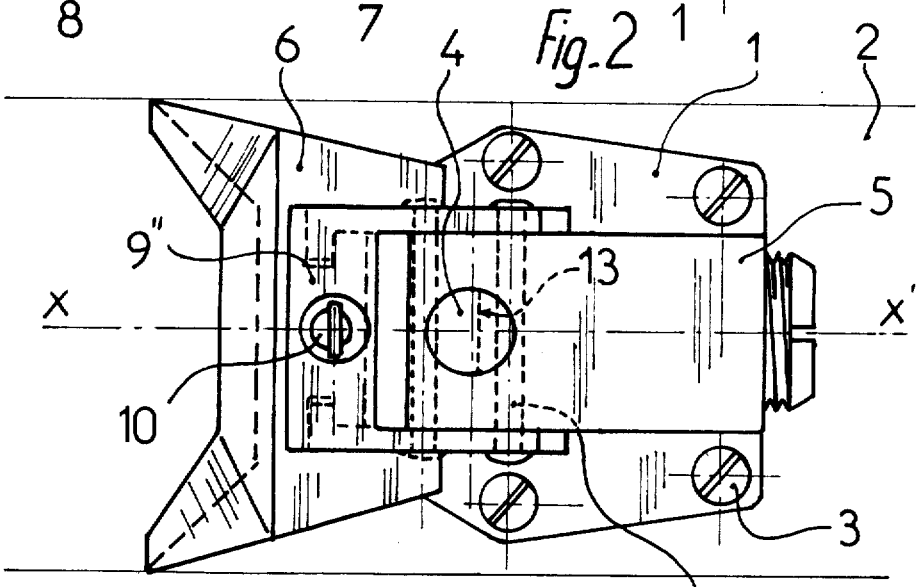
FIG. 2 is a plan view of the binding according to FIG. 1.
Figure 3:
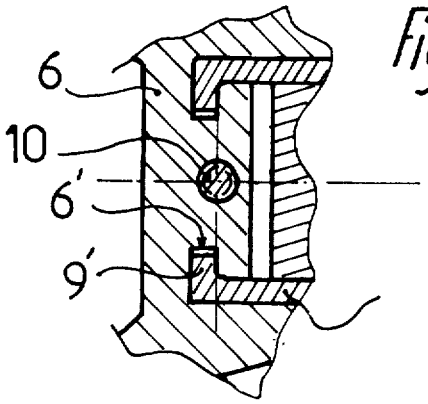
FIG. 3 is a detail in section along line III—III of FIG. 1.

With reference first to FIGS. 1 to 3, the general structure of the binding according to the invention will now be described, this structure being common to the two embodiments disclosed herein.

The binding comprises a base 1 affixed by screws 3 to the upper surface of a ski 2. Base 1 is integral with a vertical pivot 4, which, in the example shown, is generally cylindrical and is located on the longitudinal axis X—X' of the ski (FIG. 2). The body 5 of a binding member is swingably mounted on pivot 4. A jaw 6 for laterally and vertically encasing the forward portion of the sole of boot 8 adjustably mounted in a yoke 9 articulated on body 5 about a fixed axle 7 traversing the lower portion of the body, this axle 7 also serving as a cotter immobilizing body 5 in translation with respect to pivot 4. For this purpose, axle 7 engages a peripheral groove 7' of pivot 4 so as to allow free rotation of body 5 about the pivot without translating displacement.

Yoke 9 has two frontal slide flanges glidingly engaging between them jaw 6 which has corresponding slots 6'. Slide flanges 9' extend substantially vertically, so that the height of the jaw may be adjusted by gliding movement in the slide. This adjustment is facilitated by a screw 10 carried by a crosshead 9'' connecting the upper portion of the lateral branches of yoke 9, the threading of screw 10 engaging a corresponding threading of the jaw.

Figure 4:
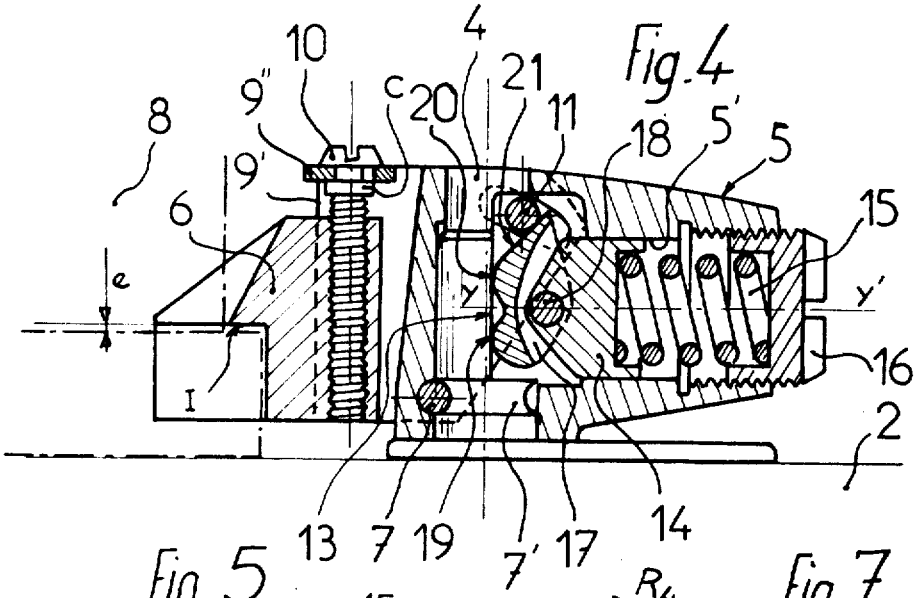
FIG. 4 shows a longitudinal section of the binding according to FIG. 1, equipped with a first embodiment of the compensating arrangement according to the invention.

It will be noted that the screw is immobilized against translation movement with respect to the yoke by a flange C located beneath crosshead 9'' (FIG. 4). Height adjustment of jaw 6 by screw 10 makes it possible to adjust the jaw to different dimensions of the boot.

At its end opposite to the jaw, yoke 9 comprises a cylindrical crosshead 11 attached to the lateral branches of the yoke and crossing the lateral walls of binding body 5 which are provided with slots 12, preferably in a circular arc, centered on axle 7 of yoke 9.

Pivot 4 is cut on a portion of its height, so as to form, in the example shown, a flat part 13 extending vertically and substantially transversely to the longitudinal axis of the ski. This flat part 13 serves as a fixed reaction member for the resilient locking arrangement, facilitating rotating displacement of the binding body during release, and its automatic return to longitudinal position.

A bore 5' is provided in binding body 5, on the opposite side of the pivot from jaw 6, this bore containing a resilient element such as spring 15.

Spring 15 is associated with a threaded plug 16 engaging threading in bore 5', the plug permitting the adjustment of tension of spring 15. Between spring 15 and pivot 4 there is a compensating mechanism housed in the interior of a chamber in binding body 5. Two embodiments of this compensating mechanism will now be described, with reference to FIGS. 4 to 8.

Figure 5:
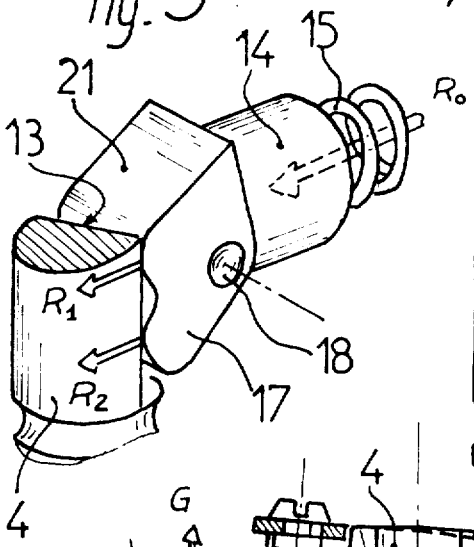
FIG. 5 is a detail view in perspective in enlarged scale of the compensating system according to FIG. 4 in normal position.
Figure 6:
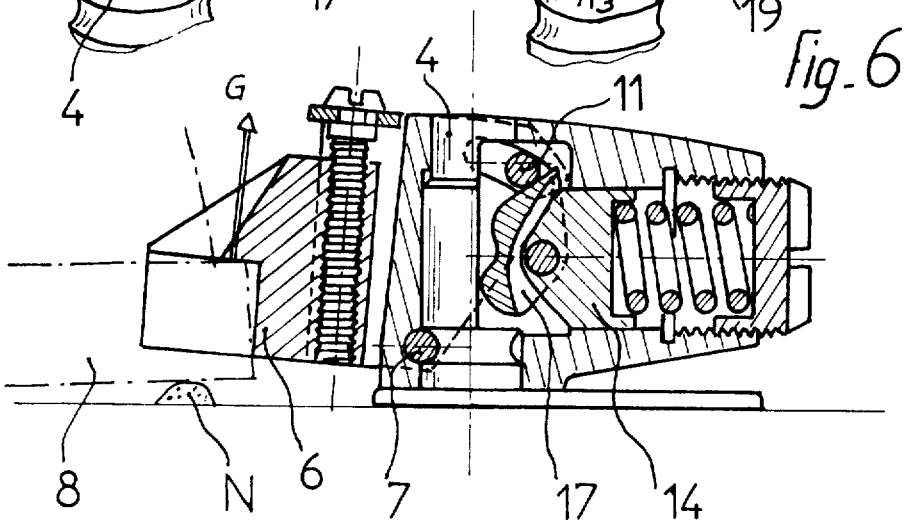
FIG. 6 is a longitudinal section of the binding according to FIG. 4 showing the compensating arrangement in operative position.

FIGS. 4 to 6 show a first embodiment of the compensating mechanism which comprises a first member or piston 14 mounted in bore 5' for unencumbered sliding movement in translation.

Provided on the forward portion of piston 14 is an axle 18 extending substantially parallel to the plane of the ski and transversely to axis Y—Y' of spring 15. Movably mounted on axle 18 is a second member 17 which may be called a rocking member, since it is free to turn about axle 18. The rocking member has a substantially U-shape, the two legs of the U being mounted on axle 18, as may be seen particularly in FIGS. 5 and 7, while the front portion of the rocking member cooperates with flat part 13 of the pivot, against which it is thrust by spring 15.

In the embodiment shown in FIGS. 4 to 6, the front face of rocking member 17 has a ramp profile comprising two transverse bosses 19 and 20 having a general shape of a portion of a cylinder, these bosses being parallel and extending transversely to axis Y—Y' of spring 15.

As may be seen particularly in FIG. 4, bosses 19 and 20 are so arranged that, in the binding position corresponding to normal retention of the boot on the ski, they contact the flat part and preferably substantially on both sides of axis Y—Y' of spring 15.

It will further be noted that the upper boss 20 is extended upwardly by an abutment surface 21 which cooperates with crosshead 11 integral with yoke 9. The functioning of the binding will now be explained with reference to FIGS. 4 to 6.

It should first be explained that, when the binding is locked in the normal boot retaining position shown in FIG. 4, i.e., when the sole of the boot is in direct contact with the surface of the ski, there is a limited play (e) between the upper surface of the sole of the boot 15 and the lower border I of the jaw.

Thus, during ordinary lateral release, i.e., by displacement of the boot in the plane of the ski, the only stress to be overcome by the boot is the lateral retention stress exerted by spring 15, and this is predetermined, corresponding precisely to the characteristics of the skier and thus providing the desired degree of safety.

In other words, ordinary lateral release proceeds without undesired friction between jaw 6 and the sole. In this case, which is shown in FIGS. 4 and 5, if the spring is adjusted to exert a retention force $R_O$, then the pressure of rocking member 17 on pivot 4 will have components $R_1$ and $R_2$ corresponding to abutment of the rocking member by its bosses on flat part 13. In this case, the whole of the thrust of spring 15 is transmitted to the flat part, as shown by the following equation:

$$R_1+R_2=R_O$$

The force of the lateral release corresponds to the lateral retention force and is thus a function of $R_O$.

However, when jaw 6 is not in the position shown in FIG. 4, e.g., because a certain accumulation of snow N is lodged between the sole of the boot and the ski (as shown in FIG. 6), or when the binding is subjected to simultaneous vertical and lateral stresses, jaw 6 contacts the sole of the boot, which asserts a vertical upward thrust indicated as G in FIG. 6. Under these circumstances, force G causes friction in opposition to lateral displacement of the boot. The force required for release of the boot is then the sum of the frictional force and the lateral retention force of the binding. In order that the effort required for release not be too great, it is desirable to reduce the retention force, and this is the purpose of the compensating mechanism.

As jaw 6 is free to turn about axle 7, elevation of the jaw is translated by rotation of the yoke 9 and of crosshead 11 associated therewith.

Figure 7:
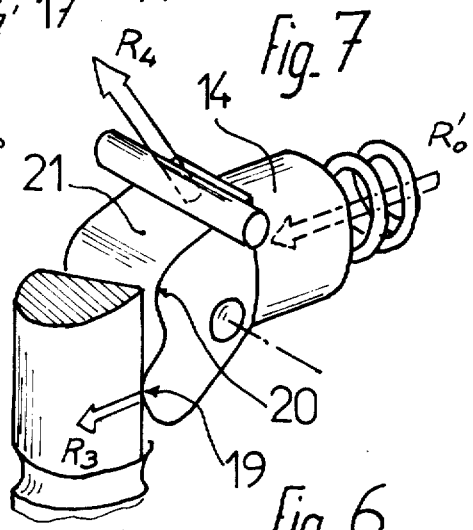
FIG. 7 is a detail view in perspective, similar to FIG. 5, but corresponding to the position of the compensating arrangement shown in FIG. 6.

Thus crosspiece 11 then exerts a force on the upper abutment surface 21 of rocking member 17 pushing the upper portion of rocking member into the position shown in FIGS. 6 and 7. This has the effect of separating boss 20 from the pivot, boss 19 being kept in contact with flat part 13 by spring 15. It will be noted that the rocking movement of rocking member 17 forces piston 14 to move counter to the action of spring 15, thereby causing the thrust of the spring to increase slightly from $R_O$ to $R'_O$ (FIGS. 4 and 5).

Force $R'_O$ of the spring then comprises horizontal thrust $R_3$ on the pivot, and reaction $R_4$ on crosshead 11. The lateral holding of the foot assured by the resilient arrangement is thus a function of force $R_3$. It will be understood that, in order to maintain the safety of lateral release under the same conditions as in FIGS. 4 and 5, it is sufficient for the sum of force $R_3$ on pivot 4 and friction G between the sole and the jaw to be equal or less than the sum $R_1+R_2$ according to FIGS. 4 and 5.

In other words, the diminution of the locking force ($R_3$ being less than $R_O$) compensates for the resistance caused by friction between the sole and the border of the jaw.

In the second embodiment shown in FIGS. 8 to 11, the elements are similar to those of FIGS. 1 to 7, the sole differences being those in the compensating mechanism. In this embodiment, the compensating mechanism also comprises a sliding member or piston 22, mounted for unencumbered translation movement in bore 5' of the binding body, as well as a rocking member 23. However, in contrast to the first embodiment, it is the sliding piston 22 which is directly in contact with the pivot, while rocking member 23 is interposed between piston 22 and spring 15. Piston 22 has the general shape of a cradle, with a substantially U-shaped portion **22*a* engaging the walls of bore 5', the U-shaped portion terminating in a vertical front wall 22*b* whose place face 22*c* is intended to contact flat part 13** of the pivot.

At the foot of the back face of the front wall there is a concave semi-cylindrical seat 25 for receiving a flange 24 of corresponding shape at the foot of rocking member 23. Rocking member 23, with the extension of flange 24, has a plane face **23*a* cooperating with the rear face of wall 22*b* of the piston. Face 23*a* of rocking lever 23 is upwardly extended by an inclined ramp 26. It will be noted that the axis of seat 25 in which rocking member 23 pivots extends parallel to the surface of the ski and transversely to axis Y—Y' of spring 15. In the normal position of the binding shown in FIG. 8, i.e., when the sole of the boot is kept separate from border I of the jaw and exerts no vertical thrust against the latter, crosshead 11 is slightly separated from ramp 26 of the rocking member, and face 23 of the latter is in contact with the piston with which it cooperates. In this situation, force $R_O$ of the spring is integrally transmitted by piston 22 in contact with flat part 13 of piston 4**. Thus the force of the piston on the pivot is equal to $R_O$.

Figure 11:
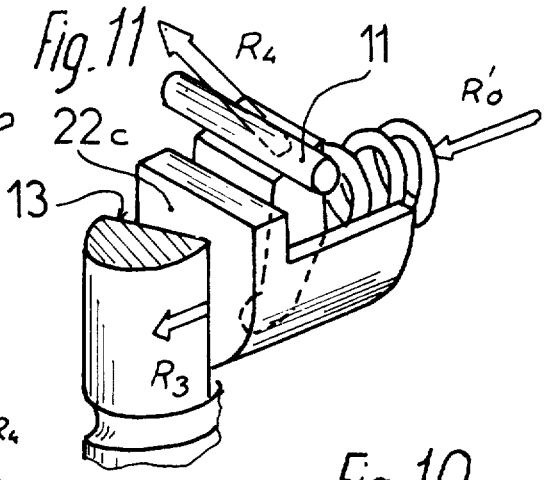
FIG. 11 is a detail view in perspective of the compensating system in the position of FIG. 10.
Figure 10:
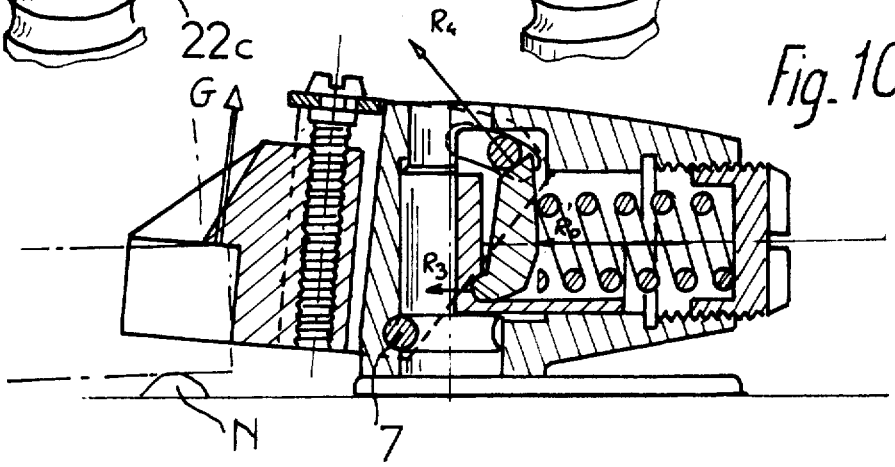
FIG. 10 is a longitudinal section of the binding according to FIG. 8 showing the compensating arrangement in operative position.

On the other hand, if, as shown in FIGS. 10 and 11, the jaw is biased in a vertical direction in receiving from the sole a vertical force G, said jaw pivots about its axis 7 and crosshead 11 abuts against ramp 26 while forcing rocking member 23 against the action of spring 15, such displacement being facilitated by rotation of rocking member 23 in its seat 25.

Figure 8:
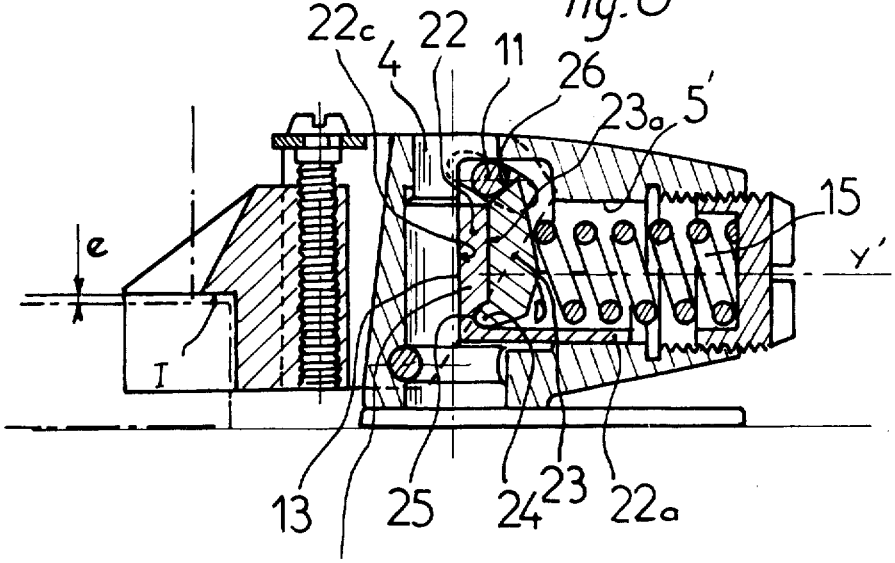
FIG. 8 is longitudinal perspective view of a binding according to the invention equipped with a second embodiment of the compensating arrangement according to the invention.
Figure 9:
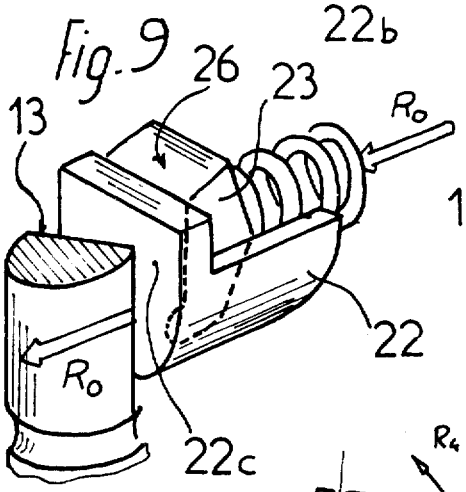
FIG. 9 is a detail view in perspective of the compensating arrangement according to FIG. 8 in the normal position shown in FIG. 8.

By reason of the displacement of rocking member 23, spring 15 is compressed and exercises a thrust $R'_O$ slightly greater than thrust $R_O$ of FIGS. 8 and 9. This thrust breaks up into force components $R_4$, exerted on crosshead 11, and $R_3$, exerted on piston 22 via seat 25.

Thus, the only force transmitted by the spring on flat part 13 of the pivot is force $R_3$, which is less than force $R_O$ of FIGS. 8 and 9. It will be understood that, to avoid a change in the required release effort with respect to that produced according to FIGS. 8 and 9, it suffices for the sum $R_3+G$ to be equal or less than thrust $R_o$ of the spring according to FIGS. 8 and 9.

The diminution of the force exerted by spring 15 on the pivot thus compensates for the resistance caused by friction between the sole of the boot and jaw 6.

In the just described embodiment, the rocking axis 24 is parallel to the plane of the ski, but it can also be placed perpendicularly.

What is claimed is:

1. Ski safety binding releasable at least laterally, comprising (a) a vertical pivot integral with a base attached to a ski;

(b) a binding member swingably mounted on said pivot and comprising means for retaining a boot;

(c) a locking arrangement comprising holding means mounted in said binding member and assuring the retention of said boot in a predetermined position on said ski, the arrangement comprising at least one resilient element and opposing a vertical retention force and a lateral retention force, respectively, to vertical elevation and to lateral displacement of said boot, said resilient element being preset to permit release of said boot when it is placed under a predetermined constraint in the plane of said ski;

(d) a compensating mechanism acting upon said locking arrangement to produce variations in the lateral retention stress on said boot inverse to the variation in the vertical retention stress, said compensating mechanism comprising two members movable relative to another and located between the kinematic chain consisting of said resilient element and a reaction member fixed with respect to the ski and located adjacent said vertical pivot;

(e) the first one of said movable members being slidably mounted for translating movement in said binding member; and (f) the second one of said members being movably mounted on said first member, in a manner allowing it to rock about an axis extending transversely to the direction of sliding movement of said first member, and cooperating through a system of ramps with said reaction member opposing vertical elevation of said boot.

2. Ski safety binding according to claim 1, wherein the rocking axis of said second member extends parallel to the plane of the ski.

3. Ski safety binding according to claim 1, wherein the sliding movement of said first member is substantially parallel to the plane of the ski.

4. Ski safety binding according to claim 1, wherein said fixed reaction member is solid with said vertical pivot about which the binding member rotates.

5. Ski safety binding according to claim 4, wherein said fixed reaction member comprises a vertical flat plate on said fixed pivot.

6. Ski safety binding according to claim 1, wherein said second member is carried by an axle integral with said first member and is interposed between said first member and said fixed reaction member.

7. Ski safety binding according to claim 6, wherein said second member cooperates with said fixed reaction member by a ramp arrangement facilitating variation of the point of abutment of said second member against said fixed reaction member when said second member is actuated in response to displacement of said boot retaining means.

8. Ski safety binding means according to claim 7, wherein said second member has an abutment surface against which is exerted the action of an element associated with the displacement of said retaining means.

9. Ski safety binding according to claim 8, wherein said ramp arrangement of said second member comprises two bosses located substantially on both sides of the shaft about which said second member rocks, and said abutment surface constitutes a prolongation of one of said bosses, in the direction opposite from the other of said bosses.

10. Ski safety binding according to claim 1, wherein said second member is engaged in a seat in said first member for free pivoting movement, said first member being interposed between said second member and said fixed reaction member.

11. Ski safety binding according to claim 10, wherein said second member is interposed between said first member and said resilient element.

12. Ski safety binding according to claim 8, wherein said second member has an abutment surface against which is exerted the action of an element associated with the displacement of said retaining means, the thrust of said element against said abutment surface causing the rocking of said second member against the action of said resilient element and, thereby, displacement of the area of contact between said rocking member and said first member.

13. Ski safety binding according to claim 11, wherein said first member comprises a sliding piston having a slide portion which is slidingly engaged in a housing in said binding body and a wall extending perpendicularly to said slide portion and cooperating with said fixed reaction member.

14. Ski safety binding according to claim 13, wherein said second member comprises a level having at one of its ends a flange in the form of a partial cylinder engaged in a seat of corresponding shape in said wall of said piston, adjacent said slide portion, the other end of said lever having an inclined abutment surface against which are exerted the forces tending to rock said lever.

* * * * *